US005839485A

United States Patent [19]

Wegman et al.

[11] Patent Number: 5,839,485

[45] Date of Patent: Nov. 24, 1998

[54] ELECTROMAGNETIC VALVE AND DEMAGNETIZING CIRCUIT

[75] Inventors: Paul M. Wegman, Pittsford; Mikhail Vaynshteyn, Rochester, both of N.Y.; David M. Korvick, Oklahoma City, Okla.

[73] Assignee: Xerox Corporation, Stamford, Conn.

[21] Appl. No.: 540,993

[22] Filed: Oct. 12, 1995

[51] Int. Cl.[6] ..... B65B 1/04

[52] U.S. Cl. ..... 141/129; 141/172; 141/192; 141/DIG. 1; 137/827; 251/129.01

[58] Field of Search ..... 141/DIG. 1, 129, 141/153, 156–158, 172, 192, 196, 198, 255, 256, 264; 137/827, 251.1; 251/129.01; 366/184; 164/129, 130, 133, 136, 323–326, 337, 498, 500

[56] References Cited

U.S. PATENT DOCUMENTS

| | | | |
|---|---|---|---|
| 3,955,613 | 5/1976 | Lund | 164/130 |
| 4,655,237 | 4/1987 | Gloor et al. | 137/251.1 |
| 4,932,355 | 6/1990 | Neufeld | 118/652 |
| 4,987,951 | 1/1991 | Dietrich et al. | 164/498 |
| 5,095,338 | 3/1992 | Hayes, Jr. et al. | 355/246 |
| 5,337,794 | 8/1994 | Nishiyama et al. | 141/144 |
| 5,438,396 | 8/1995 | Mawdesley | 355/260 |

*Primary Examiner*—Henry J. Recla
*Assistant Examiner*—Steven O. Douglas

[57] ABSTRACT

A method and apparatus for filling a container with a magnetic material using an electromagnetic valve and a demagnetizing circuit to control the flow and properties of the material. Initially an empty container is placed under a fill tube through which the material will be supplied to the container. In the filling process an auger located inside of the fill tube rotates to move the material through the fill tube. When the container is filled, the auger stops rotating and the electromagnetic valve is actuated. The electromagnetic valve supplies a magnetic field which holds the material particles in place, plugging the fill tube with the material. The filled container is removed from the fill tube and an empty container is put in its place. When the electromagnetic valve is switched off, a demagnetizing circuit is activated. After the material particles are demagnetized the auger is switched on and the material flows again to fill the container.

20 Claims, 4 Drawing Sheets

ELECTROMAGNETIC VALVE AND DEMAGNETIZING CIRCUIT

BACKGROUND

This invention relates generally to filling a container with developing material, and more particularly concerns an electromagnetic toner valve and demagnetizing circuit which controls the flow and properties of toner in a container filling process.

In toner container filling operations which use mechanical opening and closing devices to control the flow of the toner, toner is deposited on the exterior of the container when separating the cartridge from the filler after the end of the filling process. This happens because during filling the friction between the toner and the metal surfaces of the filler generates an electrostatic field. The forces of this field attract and retain toner particles on the inner and outer surfaces of the mechanical closing device. At the end of the filling cycle when the toner movement is stopped, the electrostatic field begins to dissipate. During the process of separation of the container from the filler, some of the toner particles fall off from the surfaces to which they were attracted, thereby contaminating the top of the containers. This creates an additional cost, since the containers must be cleaned after filling. Additionally, the escaping toner contaminates the surrounding environment. Another problem of current mechanical opening and closing devices is that the tooling consists of several moving parts which consume valuable time when opening and closing which results in a prolonged filling cycle. Mechanical systems also have the problem of toner buildup, the formation of large particles, which can contaminate the toner.

The problems associated with controlling the filling of toner containers are due to the properties of the toner. Toner is the image-forming material in a developer which when deposited by the field of an electrostatic charge becomes the visible record. There are two different types of developing systems known as one-component and two-component systems. In one-component developing systems, the developer material is toner made of particles of magnetic material, usually iron, embedded in a black plastic resin. The iron enables the toner to be magnetically charged. In two-component systems, the developer material is comprised of toner which consists of small polymer or resin particles and a color agent, and carrier which consists of roughly spherical particles or beads usually made of steel. An electrostatic charge between the toner and the carrier bead causes the toner to cling to the carrier in the development process. Control of the flow of these small, abrasive and easily charged particles is very difficult.

The following disclosures may be relevant to various aspects of the present invention:

U.S. Pat. No. 5,337,794
Inventor: Nishiyama et al.
Issued Aug. 16, 1994
U.S. Pat. No. 5,438,396
Inventor: Mawdesley
Issued Aug. 1, 1995
U.S. Pat. No. 5,095,338
Inventor: Hayes, Jr. et al.
Issued: Mar. 10, 1992
U.S. Pat. No. 4,932,355
Inventor: Neufeld
Issued: Jun. 12, 1990

The relevant portions of the foregoing disclosures may be briefly summarized as follows:

U.S. Pat. No. 5,337,794 describes a powder filling apparatus and a method for filling a container with powder. The toner container is filled by conveying toner from a supply hopper through a nozzle with a valve on the end. The valve is disposed at the bottom opening of the nozzle to release and close the opening of the nozzle by the vertical movement of the valve element.

U.S. Pat. No. 5,438,396 is drawn to a toner anti-dribble device which is attached to a toner container having a vertical fill tube and a rotatable auger for feeding toner into a toner container. The toner anti-dribble device also has a sleeve member engagable with the fill tube. A plurality of flexible insertion wires are inserted through the sleeve member into the toner container and disposed substantially perpendicular to the insertion direction of the toner. The arrangement of the wires positively prevents toner dribble between fills while being flexible enough to flex in proportion to the fill rate, which prevents fusing of the toner on the wires.

U.S. Pat. No. 5,095,338 teaches a developer which discharges used carrier particles using a magnetic valve. Discharge of developer material from the developer housing is controlled by a permanent magnet and an electromagnet positioned adjacent an exit port in the developer housing. The permanent magnet generates a magnetic flux field in the region of the exit port to form a developer material curtain which prevents the passage of developer material from the exit port. When the electromagnet is energized, it generates a magnetic flux field which attracts developer material from the developer material curtain. Upon de-energization of the electromagnet, the developer material attracted to it is discharged.

U.S. Pat. No. 4,932,355 discloses a method for removing a developer mix from a developing station with a magnetic closing device which is in the vicinity of a discharge opening in the developing station. In its energized condition, the magnetic closing device creates a magnetic field which acts on the developer mix to form a plug of developer mix in the region of the discharge opening. In the de-energized condition, the magnetic closing device releases the plug of developer mix.

All of the above patents are hereby incorporated by reference.

SUMMARY

In accordance with one aspect of the present invention, there is provided a method for controlling filling a container which has the following steps: placing a first container to be filled in filling relationship to a fill tube; moving a magnetic material from a source thereof through the fill tube to fill the first container with the material; applying a magnetic force to the material in the fill tube once the first container is filled, the magnetic force being sufficient to hold the material in place in the fill tube; removing the first container; placing a second container to be filled in filling relationship to the fill tube; and removing the magnetic force applied to the material so that the material can move through the fill tube and into the second container.

Pursuant to another aspect of the present invention, there is provided an apparatus for controlling filling of a container that includes means for placing a first container in filling relationship to a fill tube; means for moving a magnetic material from a source thereof through the fill tube to fill the first container with material; means for applying a magnetic force to the material in the fill tube once the first container is filled to stop the material in the fill tube movement, the magnetic force being supplied by an electromagnetic valve; means for removing the first container; means for placing a second container to be filled under the tube; and means for removing the magnetic force applied to the material so that the material can move through the fill tube and into the second container.

Yet another aspect of the present invention provides an apparatus for filling a container with a magnetic material which has a conveyor for conveying a container under a fill tube, the container being vertically spaced from a first end of the fill tube; a device for vertically moving the container, the device moving the container so that an opening in the container engages the first end of the fill tube, the device returning the container to the conveyor once the container is filled with a magnetic material; a material supply hopper connected to the second end of the fill tube, the material supply hopper supplies the material to the container through the fill tube; an electromagnetic valve located adjacent the fill tube, the electromagnetic valve supplying a magnetic force to the material once the first container is filled and still engaged with the first end of the fill tube, the magnetic force being sufficient to stop the material movement in the fill tube; a demagnetizing circuit which supplies a demagnetizing force to the material after the electromagnetic valve is deactivated, the demagnetizing force being sufficient to demagnetize the material.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION

Figure 1:
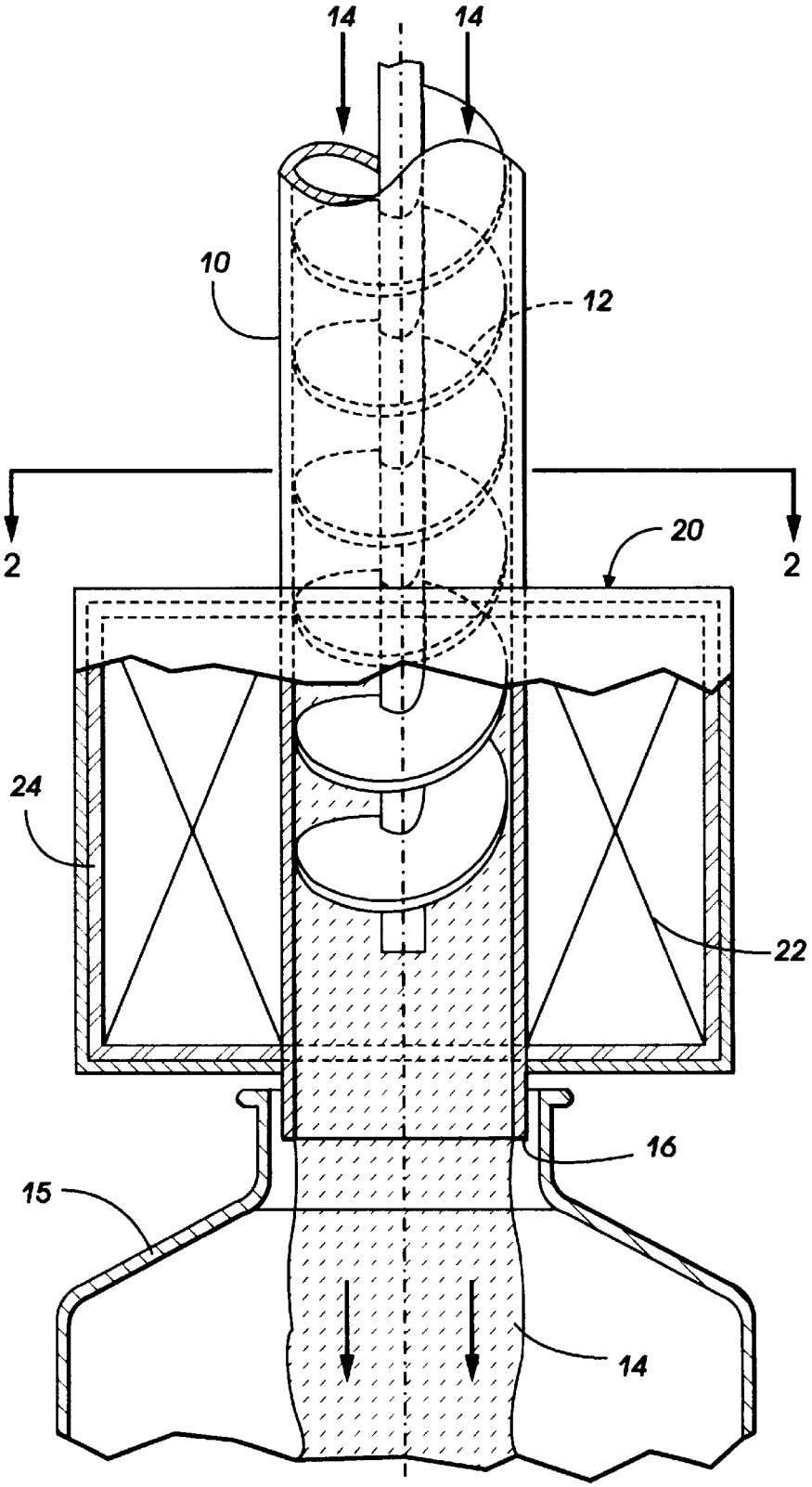
FIG. 1 is a cross-sectional view of the toner filling device.

The present invention is drawn to a static electromagnetic valve termination piece shown in FIG. 1. A fill tube 10 with a rotatable auger 12 for feeding toner 14 into a toner container 15 is shown. The fill tube is sized so that it is slightly smaller than the toner container filling opening 16. The electromagnetic toner valve 20 has a solenoid comprised of windings 22 located on the fill tube through which the toner 14 and auger 12 pass. The windings are preferably surrounded by insulation 24 for safety and cleanliness purposes. When the toner valve is under power, the solenoid will generate an axial magnetic field sufficient to freeze or stop all toner particles inside the tube including those on the auger.

Figure 2:
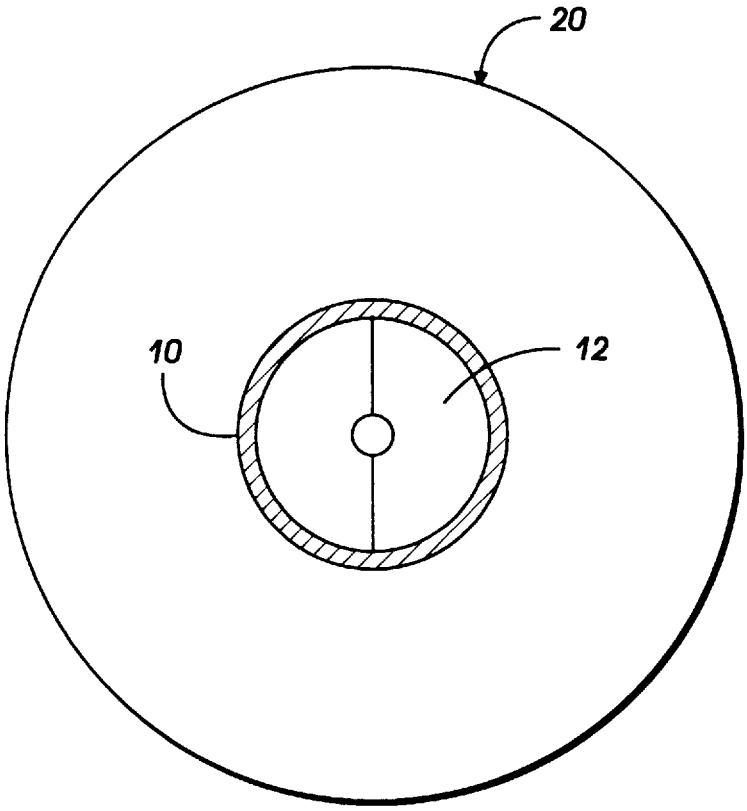
FIG. 2 is a plan view taken along line 2—2 of FIG. 1.

FIG. 2 shows a plan view of the invention with the valve 20 surrounding the fill tube 10, the auger 12 being centrally located in the fill tube. The auger is preferably made of stainless steel and the fill tube is preferably made of "Teflon" or stainless steel.

Figure 3:
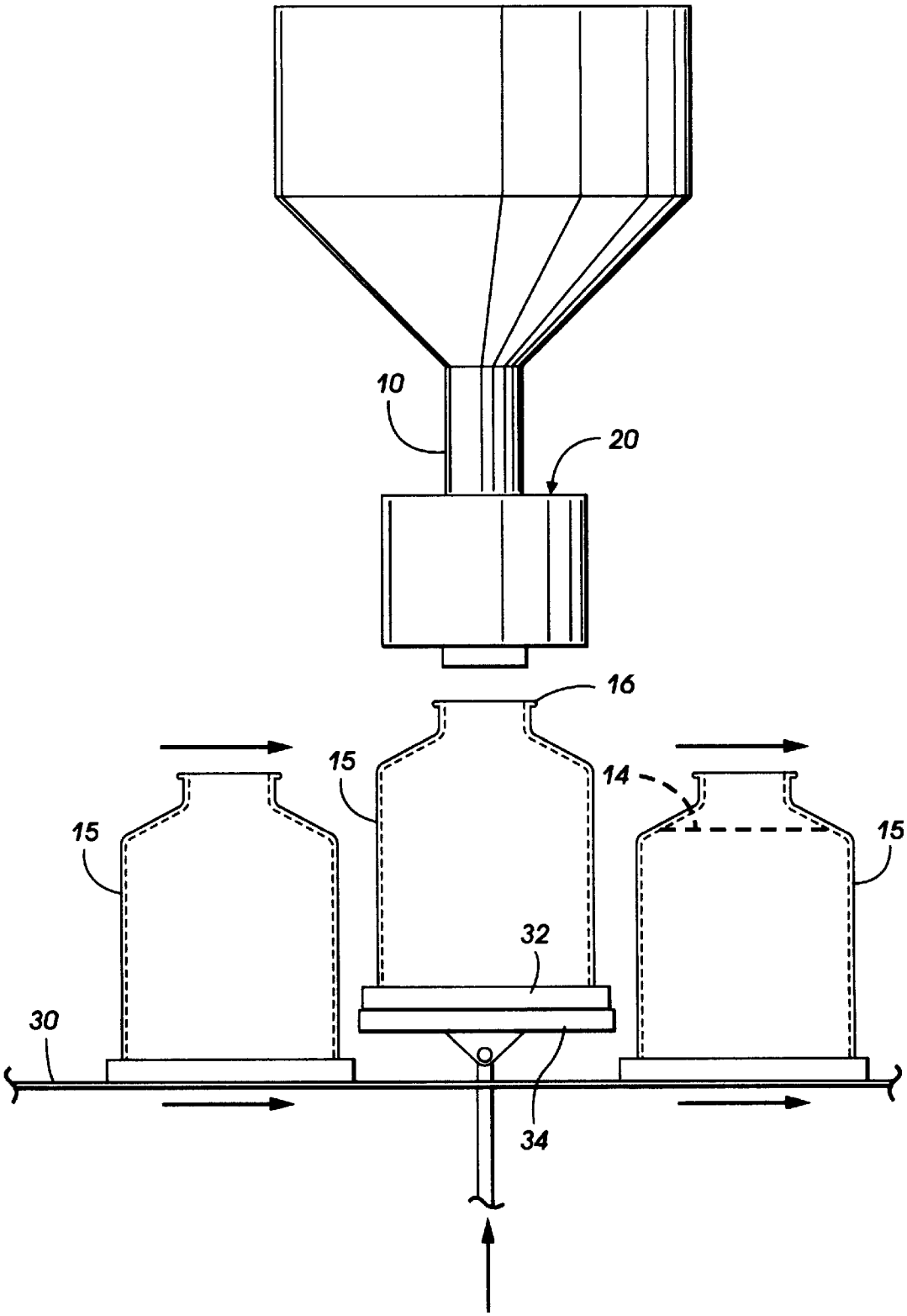
FIG. 3 is a side view of the container filling system prior to filling the container.

FIG. 3 depicts a side view of moving the containers along an indexing conveyor 30 relative to the fill tube 10. Each of the containers is positioned in a carrying device 32, also known as a puck. Each puck is specially designed and built for each type of toner container, the puck allowing for different container widths and heights. A puck is used so that the same conveying and lifting system can be used with varying toner container types. When the container is in position under the fill tube the lifting mechanism 34 pushes the puck with the container in it up until the lifting mechanism is fully extended. When the lifting mechanism is fully extended, the container is in the proper filling relationship with the fill tube.

Figure 4:
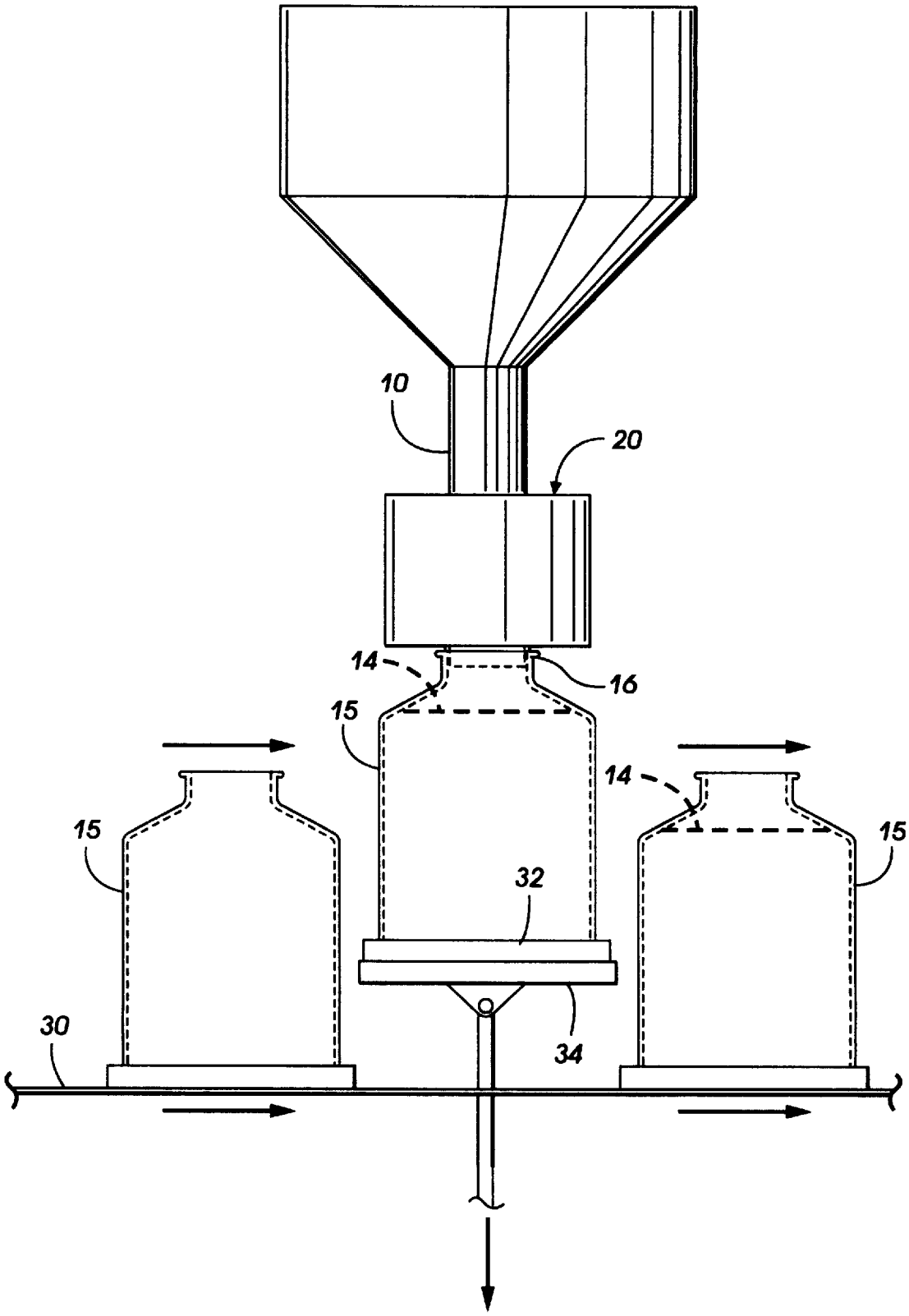
FIG. 4 is a side view of the container filling system after the container is filled.

FIG. 4 shows the container in the proper filling relationship to the fill tube, the container opening 16 receiving the end of the fill tube 10. The auger in the fill tube is operated to move the toner 14 through the fill tube 10 and the valve 20, and the toner container 15 is filled with toner 14. The amount of toner loaded in the container is predetermined based on the size of the container and the toner flow is mainly controlled by the number of rotations of the auger. During the filling operation the toner valve is powered off. After the auger toner filling process is completed, just before the cartridge is separated from the fill tube, the valve is turned on and operates to provide a non-contact magnetic seal which prevents the material from flowing out of the auger or dropping off of the tube. The valve remains powered on while the filled container is removed and an empty container is put into place for filling.

Before the toner valve is turned off so that the toner is allowed to flow into the empty container, an additional operation must be performed. Due to magnetic hysteresis effect, the particles which were held by the toner valve will retain some magnetic properties which will cause the toner to stick together which makes the toner unusable. To overcome this problem of magnetized toner, the system requires a device to demagnetize the frozen toner before the valve is opened.

Figure 5:
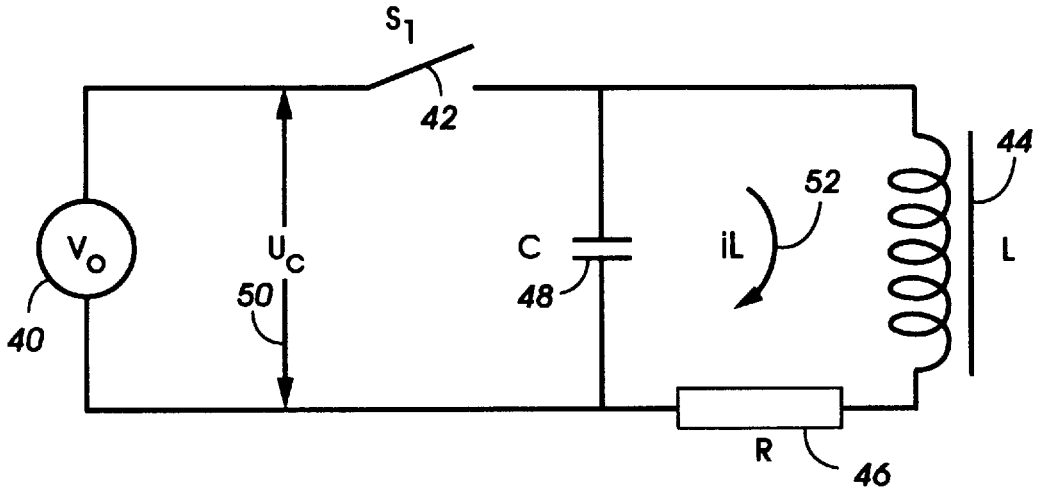
FIG. 5 is a schematic of the demagnetizing circuit.

FIG. 5 depicts a toner demagnetizing circuit which provides a rapid oscillative damped magnetic field. The circuit is integrated into the winding of the electromagnetic toner valve. When the toner valve is switched off, opening switch S1 42 the constant voltage source $V_0$ 40 which powers the toner valve is disconnected and the damped oscillation magnetic field is generated by the transient process at the winding of the valve solenoid, L 44 being the inductance of the solenoid 22 and R 46 being the resistance of the solenoid 22 or an external resistor, depending upon the desired operating conditions of the circuit. At this moment an electric capacitor C 48 which is parallel to the solenoid winding 22, is brought into a circuit and provides a decaying oscillating voltage source $U_C$ 50 causing $i_L$ current 52 through the coil which generates the oscillating magnetic field at the windings of the valve. This oscillating magnetic field demagnetizes the toner in the valve leaving no measurable residual magnetization.

The component relationships governing the design of the demagnetizing circuit will now be described. After the switch S1 is turned off, the current at the solenoid winding can be described by the following equation:

$$iL_{(t)}=I_0e^{-t/T}(\cos wt+\tfrac{1}{2}Q\sin wt) \qquad \text{Equation (1)}$$

where $I_0=V_0/R$—constant current at the winding, which is necessary for valve closure operation;

$T=2L/R$ —time constant of the oscillatory circuit;

$Q=\sqrt{L/C}/R$—quality factor for the oscillatory circuit;

$w=1/\sqrt{L/C}$

The voltage $U_c$ at the capacitor C plates are represented by the equation:

$$U_C(t)=V_0e^{-t/T}(\cos wt+Q\sin wt) \quad \text{Equation (2)}$$

where $V_0$ is the constant voltage source which powers the valve and T, Q and w are the same as in equation (1). To have the transient process be an oscillatory operation, there must be that $Q\approx 1$. In this case equations (1) and (2) are simplified to:

$$i_L(t)\approx i_0e^{-t/T}\cos wt \quad \text{Equation (3)}$$

$$U_C(t)>>QV_0e^{-t/T}\sin wt \quad \text{Equation (4)}$$

From equations (3) and (4) it is possible to see that the maximum voltage at the capacitor C (and also at the contacts of the toggle switch S1 exceed $V_0$ in Q times, which limits the factor of quality of the circuit. The time constant $T=2L/R$ defines the duration of the transient process. It is possible to show that at the ratio of the length of solenoid winding to its diameter exceeding 2 this duration depends only upon the dimensions of the coil and upon the specific resistance value of the winding wire r, and in precise form:

$$T\approx 0.1\ \pi m_o D^2M/[r(Da+1)] \quad \text{Equation (5)}$$

where

D—diameter of the winding; Da—average diameter of winding

M—thickness of the winding;

$m_o$—magnetic permeability of free space, since auger is only a small portion of the inner volume of the solenoid.

During calculation of the winding turns number (or inductance value) it is necessary to obtain a compromise between the requirement for current $i_0$ reduction (so as to diminish the value of the power, which is dissipated and in this way to diminish the heating of the winding) and lowering of the maximum amplitude of the voltage of transient process at the capacitor C. With the increase of the number of the winding turns (with the same cross section of the winding) in the same proportion drops the heating of the coil, but at inverse ratio increases the voltage at the capacitor.

It should be noted that if it were not for the specific properties of toner which require proper charging, the demagnetization circuit would not be necessary. Thus the electromagnetic valve could be used by itself to control the flow of other types of magnetic particles. The movement of other developing material which can be controlled with the electromagnetic valve include dry developer, liquid ink and ink jet ink.

In recapitulation, an electromagnetic toner valve and demagnetizing circuit have been described as allowing for a non-mechanical method of controlling toner flow for filling toner cartridges or bottles. This method ensures that toner movement from the fill tube is stopped while the toner valve is activated and that the toner is not improperly magnetized.

It is, therefore, apparent that there has been provided in accordance with the present invention, a toner flow control valve that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A method for controlling filling a container, comprising:

placing a first container to be filled in filling relationship to a fill tube;

moving a magnetic particulate material from a source thereof through the fill tube to fill the first container with the material;

applying a magnetic force to the material in the fill tube once the first container is filled, the magnetic force being sufficient to hold the material in place in the fill tube;

removing the first container;

placing a second container to be filled in filling relationship to the fill tube; and removing the magnetic force applied to the material so that the material can move through the fill tube and into the second container.

2. A method as claimed in claim 1, wherein the material is a developing material.

3. A method as claimed in claim 2, wherein the material is toner.

4. A method as claimed in claim 2, wherein the material is developer.

5. A method as claimed in claim 2, wherein said removing the magnetic force applied to the material step further comprises applying a demagnetizing force to the material so that the material is demagnetized.

6. A method as claimed in claim 1, wherein said applying a magnetic force step is comprised of activating an electromagnetic valve.

7. A method as claimed in claim 6, wherein said removing the magnetic force step is comprised of deactivating the electromagnetic valve.

8. A method as claimed in claim 7 wherein said said removing the magnetic force step further comprises activating a demagnetizing circuit, the demagnetizing circuit producing an oscillating damped magnetic field which is sufficient to demagnetize the material.

9. A method as claimed in claim 1, wherein said moving step further comprises starting the rotation of an auger, located in the fill tube, when the first container is placed in filling relationship to the fill tube.

10. A method as claimed in claim 9, further comprising a stopping step comprised of stopping said rotation of the auger when the first container is filled.

11. A method as claimed in claim 1 wherein said placing the first container step further comprises:

conveying the first container along a conveyor until the container is located under the fill tube; and lifting the first container so that an opening in the first container engages the fill tube.

12. An apparatus for controlling filling of a container, comprising:

means for placing a first container in filling relationship to a fill tube;

means for moving a magnetic particulate material from a source thereof through the fill tube to fill the first container with material;

means for applying a magnetic force to the material in the fill tube once the first container is filled to stop the material in the fill tube movement, the magnetic force being supplied by an electromagnetic valve;

means for removing the first container;

means for placing a second container to be filled under the tube; and means for removing the magnetic force applied to the material so that the material can move through the fill tube and into the second container.

13. An apparatus as claimed in claim 12, wherein the material is a developing material.

14. An apparatus as claimed in claim 13, wherein the material is toner.

15. An apparatus as claimed in claim 13, where the material is developer.

16. An apparatus as claimed in claim 13, wherein said removing the magnetic force means applied to the material step further comprises a demagnetizing circuit which produces an oscillating damped magnetic field sufficient to demagnetize the material.

17. An apparatus as claimed in claim 12, wherein said moving material means comprises an auger which is located in the fill tube.

18. An apparatus as claimed in claim 12, wherein said placing the first container means further comprises:

conveying means for conveying the first container until the container is located under the fill tube; and lifting means for lifting the first container so that an opening in the first container engages the fill tube.

19. An apparatus for filling a container with a magnetic material comprising:

a conveyor for conveying a container under a fill tube, the container being vertically spaced from a first end of the fill tube;

a device for vertically moving the container, the device moving the container so that an opening in the container engages the first end of the fill tube, the device returning the container to the conveyor once the container is filled with a magnetic material;

a material supply hopper connected to the second end of the fill tube, the material supply hopper supplies the material to the container through the fill tube;

an electromagnetic valve located adjacent the fill tube, the electromagnetic valve supplying a magnetic force to the material once the first container is filled and still engaged with the first end of the fill tube, the magnetic force being sufficient to stop the material movement in the fill tube;

a demagnetizing circuit which supplies a demagnetizing force to the material after the electromagnetic valve is deactivated, the demagnetizing force being sufficient to demagnetize the material.

20. A method for controlling filling a container, comprising:

placing a first container to be filled in filling relationship to a fill tube:

moving a magnetic material from a source thereof through the fill tube to fill the first container with the material;

applying a magnetic force to the material in the fill tube once the first container is filled by activating an electromagnetic valve, the magnetic force being sufficient to hold the material in place in the fill tube;

removing the first container;

placing a second container to be filled in filling relationship to the fill tube; and removing the magnetic force applied to the material by deactivating the electromagnetic valve so that the material can move through the fill tube and into the second container.

* * * * *